United States Patent [19]

Fisk

[11] Patent Number: 4,628,812

[45] Date of Patent: Dec. 16, 1986

[54] VARIABLE DATA IMPRINTER FOR CREDIT CARDS AND THE LIKE

[76] Inventor: James C. Fisk, 26 S. Oak Forest Dr., Asheville, N.C. 28803

[21] Appl. No.: 662,513

[22] Filed: Oct. 19, 1984

[51] Int. Cl.[4] ..... B41J 1/32

[52] U.S. Cl. ..... 101/109; 101/110; 101/269

[58] Field of Search ..... 101/59, 79, 85, 95, 101/99, 106, 109, 110, 111, 269; 179/90 FW

[56] References Cited

U.S. PATENT DOCUMENTS

| | | | |
|---|---|---|---|
| 3,059,570 | 10/1962 | Wagner | 101/19 |
| 3,279,369 | 10/1966 | Wight | 101/269 |
| 3,690,249 | 9/1972 | Nihira et al. | 101/95 |
| 3,704,668 | 12/1972 | St. Onge et al. | 101/269 |
| 3,882,773 | 5/1975 | Cook et al. | 101/110 |
| 4,155,302 | 5/1979 | Sato | 101/110 X |
| 4,227,453 | 10/1980 | McInnis | 101/269 X |
| 4,335,280 | 6/1982 | Butchko | 179/90 FW |
| 4,393,768 | 7/1983 | Barbour | 101/269 X |
| 4,485,735 | 12/1984 | Jonca | 101/110 X |

*Primary Examiner*—Edgar S. Burr
*Assistant Examiner*—John A. Weresh
*Attorney, Agent, or Firm*—Burton, Parker & Schramm

[57] ABSTRACT

A credit card imprinter having a number of rotatable type faces to imprint the amount of purchase on a credit card receipt. The type wheels are coaxially arranged and rotatably supported adjacent and in contact with the receipt to be imprinted. The imprinter is provided with a mechanism for positioning the type wheels which includes a member which translates along the type wheels to successively set same to the desired position, thereby allowing all of the type wheels to be positioned with a single mechanism. A roller is then used to imprint the type on the receipt and the type wheels are reset to the starting position by a reset mechanism.

25 Claims, 18 Drawing Figures

FIG. 12
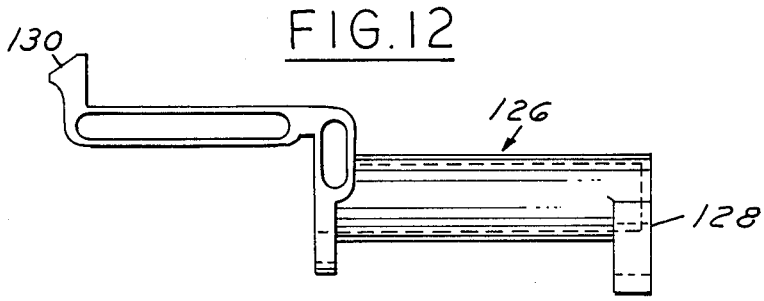
FIG. 13
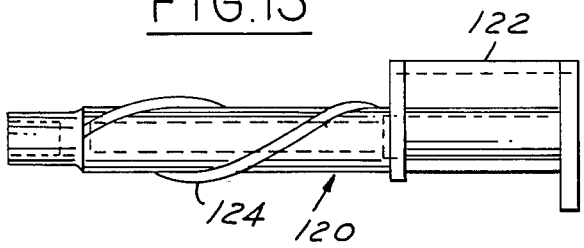
FIG. 14
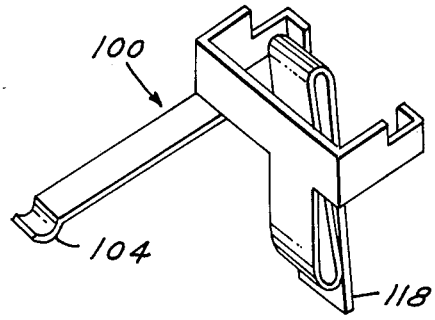
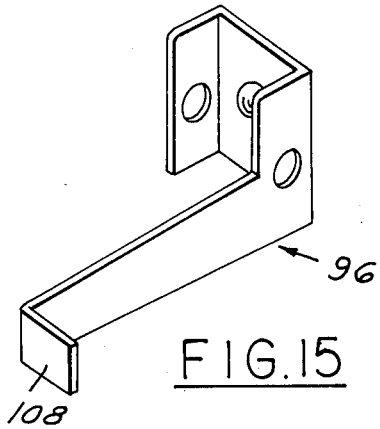
FIG. 15
FIG. 16
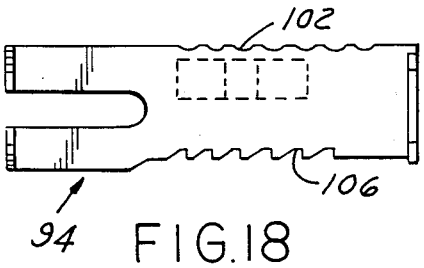
FIG. 18
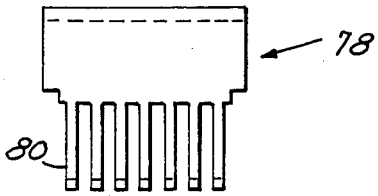
FIG. 17
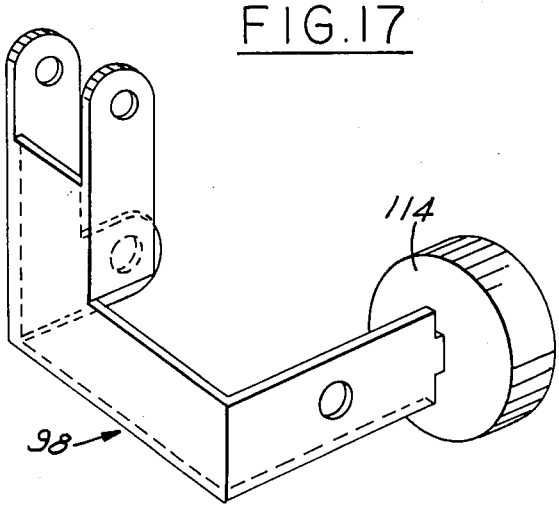

VARIABLE DATA IMPRINTER FOR CREDIT CARDS AND THE LIKE

FIELD OF INVENTION

This invention relates to the field of data imprinters and more particularly to data imprinters capable of imprinting variable data for use in recording credit card sales transactions.

BACKGROUND OF INVENTION

Imprinters typically used in recording credit card sales transactions may be broadly classified as the type having variable data imprinting means and the type capable of only recording preset data contained on the imprinter and the credit card. An example of a credit card imprinter of the type which merely records the information on the credit card and the information on the dealer's plate affixed to the imprinter is shown in U.S. Pat. No. 3,810,424 (Barbour). The printer has a generally horizontal upper deck which supports the purchaser's credit card and a dealer plate affixed to the deck containing the dealer's name, address and identification code. The multi-ply credit card receipt is placed on the deck above the credit card and dealer plate and then a roller is translated across the deck imprinting the raised indicia on the credit card and dealer plate onto the multi-ply receipt. The dollar amount of the sale and other information, such as the date and cardholder's signature is then written on the receipt by hand.

A current trend in the industry is to use optical reading equipment to process the credit card receipts. Optical reading equipment cannot reliably read handwritten dollar amount due to the wide variation in handwriting styles. It is, therefore, necessary to imprint the dollar amount on the receipt with a type wheel if the receipt is to be automatically read by optical equipment. A number of credit card imprinters having dollar amount wheels which can be set by the user are presently available. An example of such a device is shown in U.S. Pat. No. 3,739,716 (Barbour) which employs a number of toothed racks, each of which engage a gear formed on a rotating type wheel. The user positions the handle portion affixed to the rack to set the dollar amount of the transaction. Each of the type wheels act independently of one another.

A problem with conventional credit card imprinters capable of printing variable data is that the devices tend to be bulky and occupy a great deal of counter space. Credit card imprinters are typically placed on a counter adjacent a cash register and the counter space is often very limited. In addition, imprinters having variable dollar amount type wheels are frequently expensive, as these mechanisms are relatively complex.

SUMMARY OF THE INVENTION

I have discovered a novel imprinter for credit cards and the like having variable data input means which is quite small and compact. The compact size of the invention is achieved by a unique mechanism for positioning the type wheels which indexes along the coaxially arranged type wheels successively engaging each wheel for rotation to the desired position. This one positioning mechanism can thereby serve all of the type wheels, greatly reducing the size and complexity of the device. The imprinter also employs a unique mechanism for resetting the type wheels using a reset rotor which projects into an internal coaxial cavity formed in the type wheels. Like prior art devices, my apparatus includes a frame, a plurality of type wheels, means for rotatably supporting the type wheels, means to press the document against the type wheels, and resetting means. In addition to the novel mechanism for positioning the type wheels, my invention also incorporates a novel means to depress the document against the type wheels which comprises a carriage guided on recirculating ballbearings for translation the length of the document. Attached to the carriage and pivotable along an axis generally perpendicular to the linear path of the carriage travel is a roller frame having one end for cooperating with the user, and the other end for rotatably supporting a roller along an axis parallel to the axis of the roller frame. The force exerted by the user on the roller frame causes it to rotate, depressing the roller against the receipt and the supporting frame which has the type wheels projecting therethrough. On the return stroke the roller frame and roller is pivoted free of the document for an easy return motion.

An additional novel feature of my imprinter is the date setter mechanism used in conjunction with the date wheels, preventing the wheel from being rotated more than one indicia at a time, A date setter is positioned adjacent the date type wheels, having individual date setter spring leaves for cooperation with each date wheel. The spring leaves may be depressed in contacting relationship with a wheel, and the wheel and date setter rotated to limit the movement of the wheel to the next adjacent indicia.

These objects and novel characteristics of the invention will become further apparent from a review of the accompanying drawings and detailed description of the preferred embodiment.

BRIEF DESCRIPTION OF THE DRAWINGS

FIG. 12 is a side view of the reset actuator;

FIG. 13 is a side view of the reset rotor;

FIG. 14 is a perspective view of the shift pawl spring;

FIG. 15 is a perspective view of the shift pawl;

FIG. 16 is a side view of the shift ratchet;

FIG. 17 is a perspective view of the bell crank; and

FIG. 18 is a side view of the type wheel hub.

DETAILED DESCRIPTION OF THE PREFERRED EMBODIMENT

Figure 1:
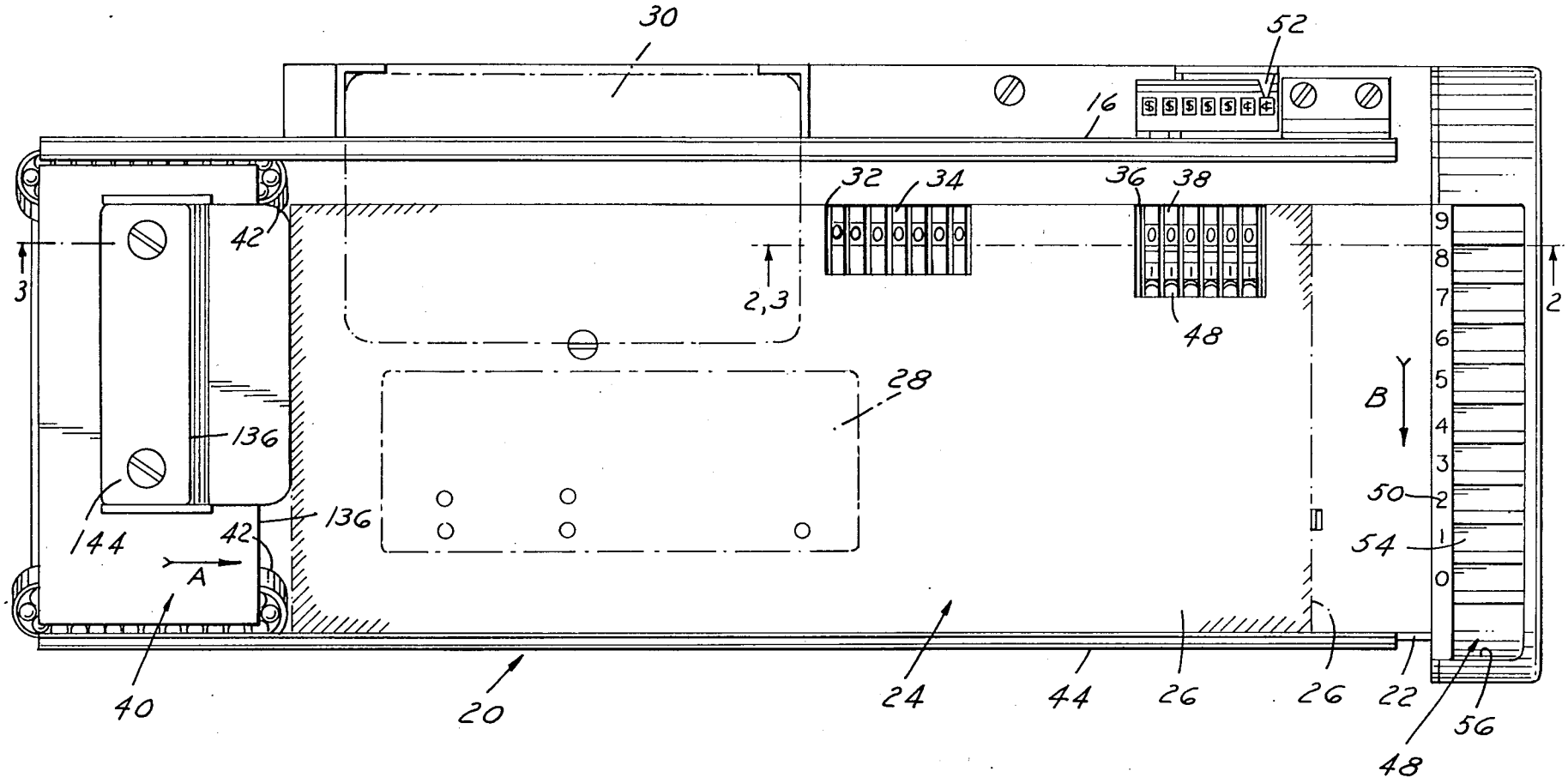
FIG. 1 is a plan view of my apparatus for imprinting of variable data.

Referring to the drawings, shown in FIG. 1 is a plan view of the preferred embodiment of the variable data imprinter generally designated as 20. The variable data imprinter has a frame 22 provided with a generally planar document support surface 24 onto which a credit card receipt 26 may be supported. The document support surface is provided with a merchant identification plate 28, a region in which the customer's credit card is retained 30, an opening 32 through which type wheels 34 project, and an opening 36 through which date wheels 38 project. Carriage assembly 40 is shown in its leftmost position and is capable of translating in the direction of the arrow A for the length of the document support surface. Carriage assembly 40 is provided with recirculating ballbearing retainers 42 integrally formed in each edge thereof, which slidingly cooperate with frame rails 44 and 46 to make up a ball bearing assembly.

At one end of the variable data imprinter is located finger ladder belt 48 which provides a means for the user to positioning the type wheels. Adjacent finger ladder belt 48 printed on frame 22 is indicia 50 corresponding to the raised indicia on type wheels 34. The user sets a type wheel by first positioning pointer 52 to the leftmost place of the character sought to be imprinted. For example, if the amount to be charged is $12.50, pointer 52 is moved to the fourth place from the right, i.e., the second place to the left of the decimal point. The user would then insert his/her finger in the recess 54 adjacent the number one and pull the finger ladder belt 48 forward in the direction of arrow B. The finger ladder belt works in a manner similar to a rotary type dial telephone, with the exception that the movement is linear rather than circular. When the user has advanced the finger ladder belt to the point where his or her finger is contacting frame end portion 56, the finger is withdrawn and the ladder automatically returns. As the finger ladder belt is moved, a type wheel is rotated so that a raised indicia is exposed corresponding to that shown adjacent the recess in which the user's finger was initially placed. During the finger ladder belt return cycle, pointer 52 automatically indexes to the next adjacent position to the right so that the next cycle of the finger ladder belt sets the next lower type wheel. In the example recited of $12.50, the user would set pointer 52 to the fourth position from the right and then sequentially advance the finger ladder belt 1, 2, 5, and 0. With the dollar amount properly set, credit card and credit card receipt 26 can be placed on document support surface 24 and carriage 40 translated across the credit card receipt, thereby imprinting the dollar amount shown on type wheels 34 as well as the information contained on the credit card and merchant's ID plate 28.

Figure 2:
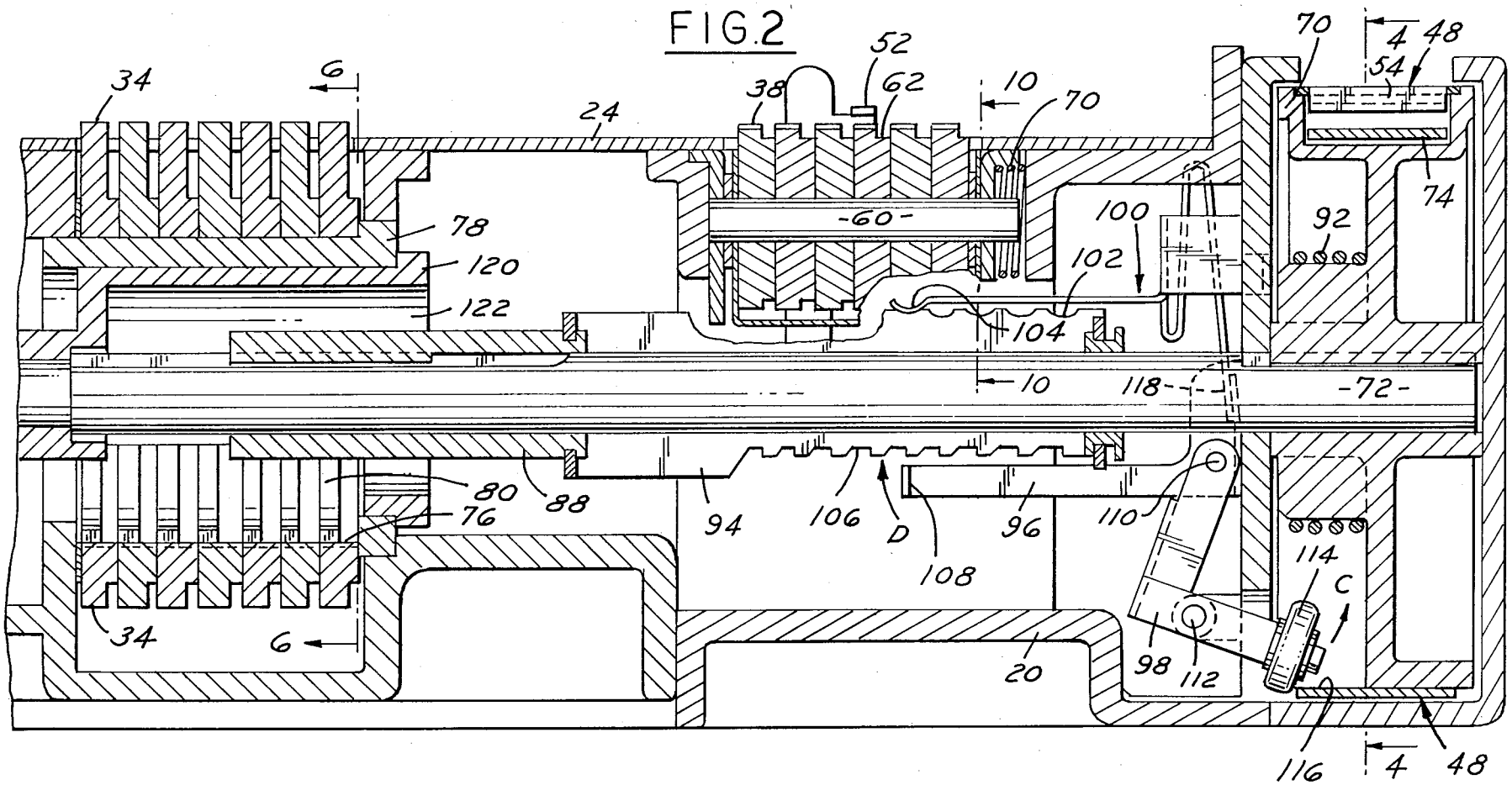
FIG. 2 is an enlarged cross-sectional view of the righthand portion of the invention taken along a line 2—2 of FIG. 1.
Figure 3:
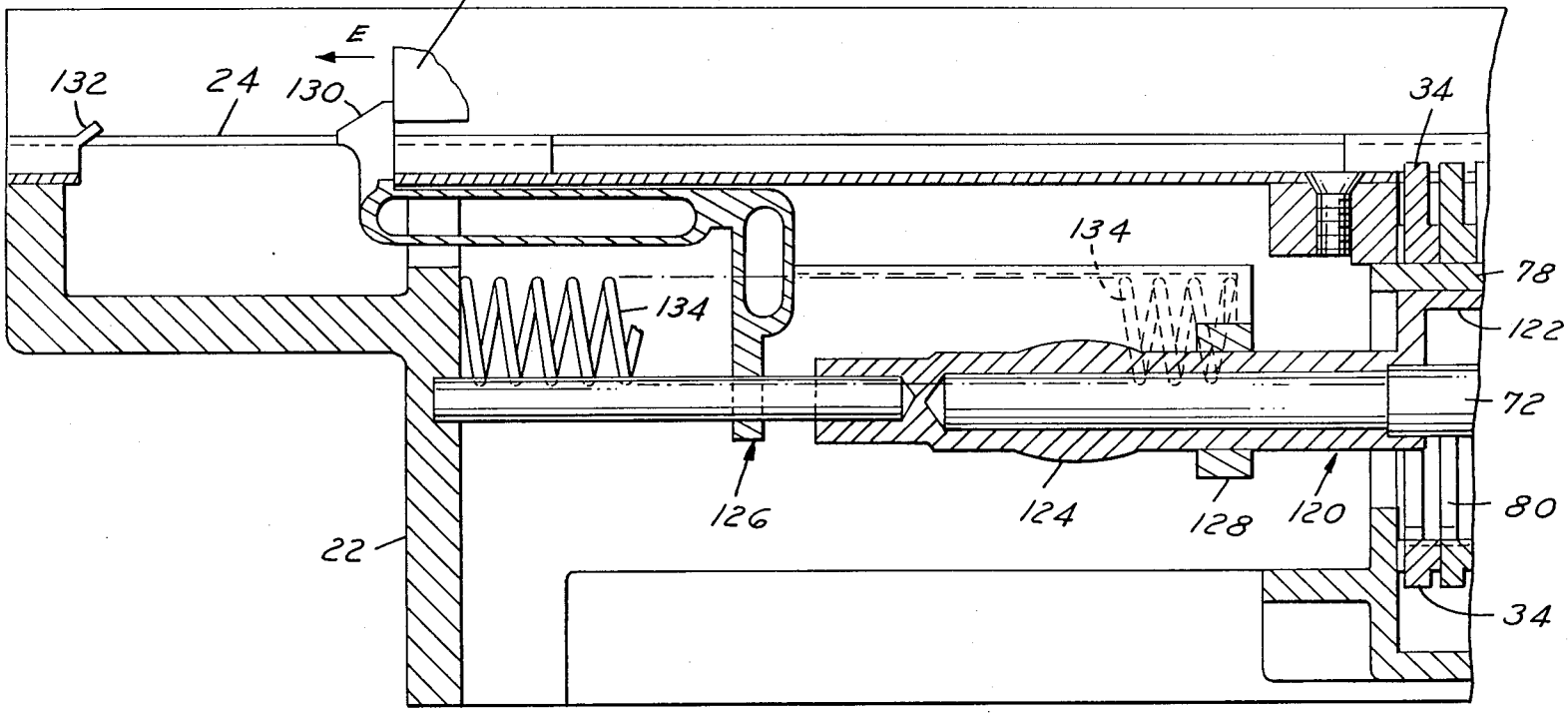
FIG. 3 is a cross-sectional view taken along 3—3 of FIG. 1 and represents the lefthand portion of the invention not shown in FIG. 2.
Figure 10:
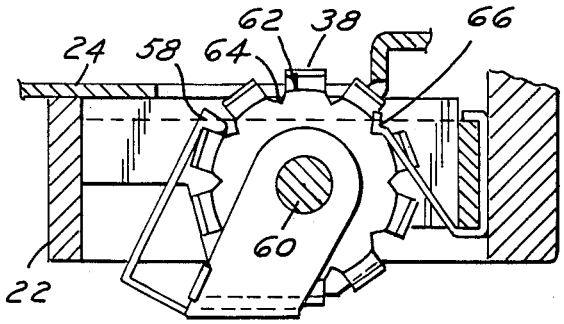
FIG. 10 is a cross-sectional view of the date wheel assembly taken along line 10—10 in FIG. 2.
Figure 11:
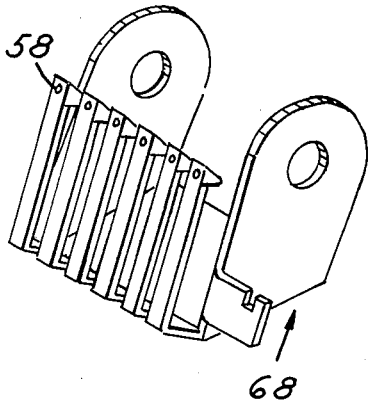
FIG. 11 is a perspective view of the date setter.

Since the date is not set as frequently as the dollar amount, disk-shaped cylindrical date wheels 38 are set manually individually by the user. A detent is provided so that the indicia located on the periphery of the date wheels line up properly. Commonly, date wheels are turned with the user's fingernail or with the aid of a sharp object. A frequent problem arising is that the user would over-turn the date wheel. To solve this problem, adjacent each date wheel is a flexible fingerlike date setter finger 58, the tip of which is visible through date wheel opening 36 in FIG. 1. A cross-sectional view of the date setter assembly is shown in FIG. 2. Date wheels 38 are shown coaxially pivotally retained on the wheel shaft 60. Note that the raised indicia does not extend across the entire width of date wheel 38, as each date wheel is provided with a recessed shoulder 62. A cross-sectional end view of the date setter assembly taken along line 10—10 of FIG. 2 is shown in FIG. 10. Located about the periphery of date wheel 38 is a series of raised indicia, either numbers or letters, which when combined can represent the date. A series of notches 64 are located in the recessed shoulder 62 for cooperation with date wheel detent 66. Date wheel detent, like date setter finger 58, is provided with a plurality of flexible elongated springy elements for cooperation with each of the individual date wheels. An enlarged perspective view of date setter assembly 68 is shown in FIG. 11. Both the date setter finger 58 and the date wheel detent 66 project into recesses 62 and notches 64 and do not contact the raised indicia. The date setter assembly, having a plurality of date setter elements 58, is pivotably rotated on shaft 60. The date setter assembly is held in the position shown in FIG. 10 against a counter-clockwise stop by date setter spring 70 (shown in FIG. 2). The date setter assembly may be rotated clockwise against date setter spring 70. In order to turn a date wheel one notch in the clockwise direction as viewed in FIG. 10, an individual date setter 58 is depressed into corresponding notch 64 with a sharp object and the date setter assembly and the engaged date wheel may be rotated clockwise. A stop provided on the date setter assembly (not shown) limits the travel so that the date wheel may not be inadvertently turned too far. Date wheel detent element 66 is deflected away from the center line of shaft 60 as the date wheel is rotated and returns into the next adjacent notch 64 to hold the date wheel in proper angular orientation.

Figure 4:
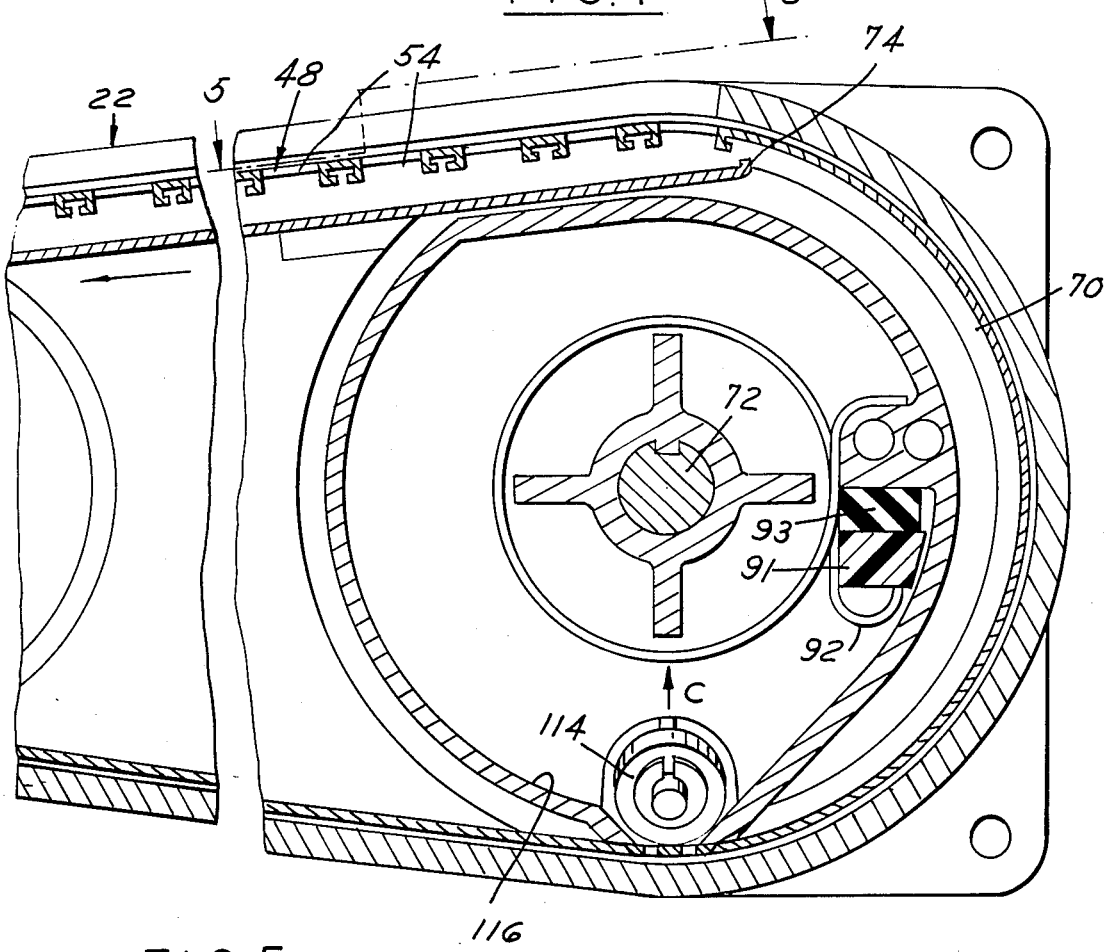
FIG. 4 is a cross-sectional view taken along line 4—4 of FIG. 2.
Figure 5:
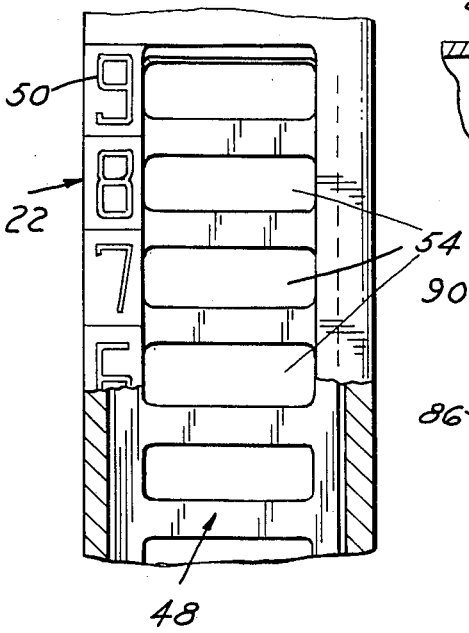
FIG. 5 is an enlarged true view of the finger ladder in the direction of arrow 5 as shown in FIG. 4.

Referring to FIG. 2 and FIG. 4, the operation of the type wheel setting mechanism will be described. Finger ladder belt 48 wraps about and is affixed to wheel 70 which in turn is affixed to type wheel set shaft 72. Finger ladder belt 48 extends about idler 49. As the finger ladder belt is moved linearly, wheel 70 and type wheel set shaft 72 rotate. A cross-sectional view taken along line 4—4 in FIG. 4. the finger ladder belt back-up plate 74 extends parallel to and immediately below linear run portion of the finger ladder belt 48 to provide a surface for supporting the user's finger tip. An enlarged view of a fragment of the finger ladder belt is shown in FIG. 5 viewed along line 5—5 in FIG. 4. Note that an opening 54 for the user's fingertip is provided adjacent each indicia or numeral 50 on frame 22. When the user inserts a finger in an opening adjacent a specific number, cycling the finger ladder belt will cause rotation of wheel 70 an amount sufficient to orient a type wheel to the position where that same number is exposed through type wheel opening 34.

Figure 6:
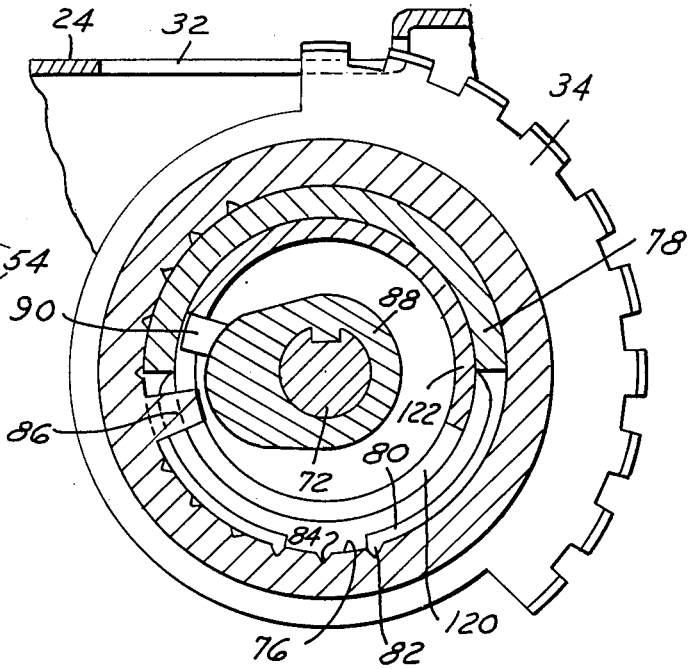
FIG. 6 is a cross-sectional view of the invention taken along line 6—6 in FIG. 2.

Type wheels 34 are coaxially located immediately below document support surface 24 as shown in FIG. 2 and FIG. 6. Each of the type wheels 34 are provided with an internal bore 76 for rotation about hub 78. Hub 78 is generally tubular in shape and is provided with a lateral slot and a series of circumaxial slots extending about a portion of the periphery to define a plurality of hub fingers 80 in pairs as shown in FIG. 6 and FIG. 18. Each hub finger 80 is provided with a pointed tip 82 for cooperation with a plurality of notches 84 formed in the type wheel internal bore 76. Hub fingers 80 serve as a detent, allowing type wheel 34 to be rotated when the hub finger tension is overcome. When the tips 82 of hub finger 80 are engaged in notches 74, the type wheel and indicia formed on the periphery of the type wheel will be held in proper alignment with the document support surface 24.

When viewing the end of hub 78 in FIG. 6, the lateral slot extending the length of the hub parallel to the hub's axis, is represented by the space between a pair of hub fingers 80. Type wheel 34 is provided with a dog 86 which projects into the type wheel internal bore 76. Dog 86 is of sufficient width to allow it to fit in the lateral slot formed between finger pairs 80 for assembly of the unit. The axial thickness of dog 86 is sized to fit between hub fingers 80 and project into the internal cavity of the hub. In the preferred embodiment depicted in the drawings, the type wheel is designed to rotate approximately 135° and the circumaxial slots in the hub extend about a sufficient portion of the hub periphery to allow the necessary rotation of dog 86.

The type wheel set wheel shaft extends through hub 78 on which type wheels 34 are rotatably mounted. Slidably affixed to type wheel set shaft 72 is set slide 88. Set slide is affixed to shaft 72 in a manner allowing it to slide axially but not turn relative to the shaft. A suitable manner for accomplishing this connection is the lateral groove and notch as shown in the drawings, or any conventional spline. Set slide 88 is provided with a tang 90 for cooperation with dogs 86. Tang 90 has an axial dimension so that only a single dog may be acted upon at one time. Set slide 88 may be positioned axially along the shaft 72 so that tang 90 will engage the dog of the type wheel desired to be set. As shown in FIG. 6, which is a cross-sectional view taken along line 6—6 in FIG. 2, as shaft 72 is rotated counter-clockwise, set slide 88 and tang 90 will rotate, causing tang 90 to engage dog 86, whereupon the type wheel will rotate relative to hub 78. Return spring 92 causes the wheel 70 and the type wheel shaft 72 to return to its original position, and during this return motion the set slide 88 is automatically indexed axially along the shaft to position tang 90 adjacent the dog of the next adjacent type wheel to the right.

The mechanism for traversing the set slide for succesive engagement with the selected type wheels comprises a shift ratchet 94, a shift pawl 96, bell crank 98 and shift pawl spring 100. Shift ratchet 94 is rotatably affixed to set slide 98 at one end and slidingly cooperates with type wheel set shaft 72 at the other. As the shift ratchet moves parallel to the axis of shaft 72, set slide 88 is moved within the axial bore of the type wheels. Shift ratchet 94 is fixed in a manner so that it cannot rotate with shaft 72. The shift ratchet is provided with a plurality of detents 102, shown in FIG. 2 and in FIG. 16. Shift pawl spring 100, shown in perspective view in FIG. 14, is provided with a cantilever spring 104 having an end cooperating with detent 102 in shift ratchet 94. Detents 102 are spaced so that tang 90 on set slide 88 will be positioned adjacent a dog on one of the type wheels. Shift ratchet 94 is also provided with a number of notches 106 having a spacing corresponding to detents 102 and type wheels 34. Shift ratchet notches 106 cooperate with shift pawl 96. Shift pawl 96 also cooperates with shift pawl spring 100 having end portion 118 exerting a force on the shift pawl generally parallel to axis 72. Shift pawl 96 is pivotably attached to bell crank 98 on pivot pin 110. Bell crank 98 is in turn essentially pivoted to the frame upon bell crank pivot pin 112. The opposite end of bell crank 98 is provided with a bell crank roller 114 for engagement with the cam of 116 integrally formed into an interanl portion of wheel 70. A cross-section of cam 116 taken along line 4—4 in FIG. 2 is shown in FIG. 4.

With reference to FIG. 4, as the finger ladder belt is moved, wheel 70 and cam 116 rotate counter-clockwise, causing bell crank roller 114 to initially move upwards in the direction of arrow C. When the finger ladder belt is released, return spring 92 causes wheel 70 to return to its original position as shown in FIG. 4, allowing bell crank roller 114 to drop down to te position shown. Return spring 92 is affixed to wheel 70 at one end and to lug 91, which is part of the housing, at the other end. Elastic stop 93 may be affixed to the lug or the wheel to gradually decelerate the two relative to one another when the finger ladder belt is released by the user. The movement of the bell crank roller up and down on arcuate path C, as shown in FIG. 2, provides the forcible mechanical motion necessary for the shifting of the set slide 88 and the accompanying tang 90 to the next adjacent type wheel dog. Referring back to FIG. 2, as bell crank roller 114 is moved upward by cam 116, bell crank 98 rotates counter-clockwise causing shift pawl pivot pin 110 to move along an arcuate path. As shift pwl pin 110 moves, shift pawl end 118 moves initially on an arcuate path shown by arrow D to engage shift ratchet notches 106. Shift pawl spring end portion 118 exerts a force on the shift pawl spaced apart from the center line of shift pawl pivot pin 110, thereby causing the shift pawl to rotate clockwise as shown in FIG. 2 when bell crank roller 114 is moved upward. After shift pawl end portion 118 engages shift ratchet notch 106, further movement of bell crank roller 114 causes shift pawl 96 to move axially, allowing shift pawl end portion 118 to engage the next notch on shift ratchet 94.

At the end of each setting cycle, wheel 70 is returned to its initial position by return spring 92 and shift pawl spring 100 returns the shift pawl to the position shown in FIG. 2 where shift pawl end portion 108 is not contacting shift pawl ratchets 106. Pointer 52 (shown only in FIG. 1) as previously described, is now free to set the set slide to the desired initial position so that tang 90 cooperates with the dog on the first type wheel desired to be set. Pointer 52 is attached to shift ratchet 94 so that the shift ratchet may be moved axially against the resistance caused by cantilever spring 104 in detent 102.

After all the type wheels have been set to the desired position and a credit card transaction recorded, it is necessary to return the type wheels to an initial zero position. To provide a means to reset the type wheels to a starting position, a preferred embodiment employs reset rotor 120 shown in FIGS. 2, 3, 6 and 13. Reset rotor 120 is provided with a C-shaped cylindrical segment 122 extending through the internal bore in hub 78 which in turn is within the internal bore of the type wheels. The cylindrical segment 122 of the reset rotor is generally coaxial with shaft 72, set slide 88, hub 78 and type wheel bore 76, as shown in FIG. 6. The cylindrical segment portion 122 of the reset rotor is shown in the initial starting position in FIG. 6. Dog 86 is shown in the zero position. When located in the "9" position the dog would be adjacent the clockwise edge of cylindrical segment 122. To reset the type wheels back to the zero position, the reset rotor is rotated in a clockwise direction as viewed in FIG. 6, causing the reset rotor cylindrical segment 122 to engage the dogs 86 on all of the type wheels, causing them to be returned to the zero position shown. After the reset function is completed, the reset rotor is returned by spring 134 to the position depicted, in FIG. 6, allowing sufficient space for the type wheel dog to rotate. In the preferred embodiment depicted, all ten numerals formed on the periphery of the type wheel 34 are located in a segment less than 180°; 135° as shown is satisfactory. Ample space must be provided so that dog 86 may rotate through a comparable angle. The reset rotor, in order to return the top wheel dogs to their starting position, must also be capable of rotating a like angle, i.e., 135° as shown in the drawings.

Reset rotor 120 is provided with a threaded end portion 124. The threaded reset rotor end cooperates with a reset actuator 126. The threaded end of the reset rotor 124 is generally coaxial with shaft 72 and the type wheel assembly. The threaded end portion of the reset rotor extends through a nut 128 formed on one end of the reset actuator. The reset actuator is fixed so that it cannot rotate about the center line of the reset rotor. However, the actuator may translate linearly generally parallel to the axis of the reset rotor and shaft 72. As the reset actuator is translated linearly, the reset rotor is caused to rotate by the engagement of the reset actuator nut 128 with the threaded end portion of the reset rotor 124. The threaded end portion of the reset rotor 124 is provided with a thread which in the preferred embodiment as shown in the drawings has a pitch of three inches and a helix angle of approximately 30° relative to the reset rotor center line.

The reset actuator 126 is also provided with an end 130 for engagement with the carriage 40 and ramp surface 132 of frame 22. During the carriage resetting motion, when the carriage is moving in the direction of arrow E in FIG. 3, the corner of carriage 40 contacts reset rotor actuator end 130. The reset actuator and carriage are caused to move together until reset actuator end 130 engages ramp 132 formed in frame 22. Ramp 132 causes the reset actuator end 130 to deflect downward for a sufficient distance to cause the end to drop below the level of carriage 40, at which time actuator spring 134 causes the reset actuator to return to the position shown in FIG. 3. When the carriage is translated during the document imprinting stroke, the reset actuator end 130 and the corresponding mating surface on the carriage are designed so that the reset actuator end is deflected downward to allow the carriage to pass freely.

Figure 7:
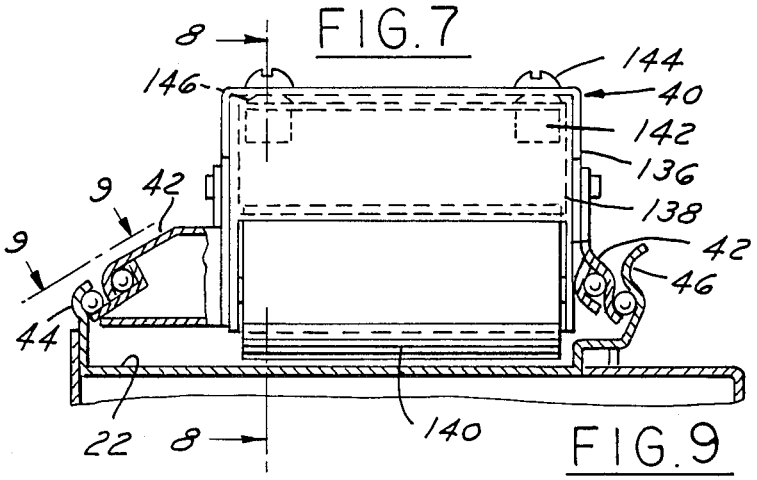
FIG. 7 is a righthand view of the carriage assembly shown in plan view in FIG. 1.
Figure 9:
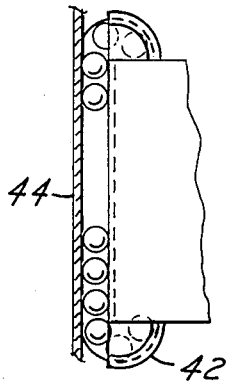
FIG. 9 is a view taken along lines 9—9 of FIG. 7.
Figure 8:
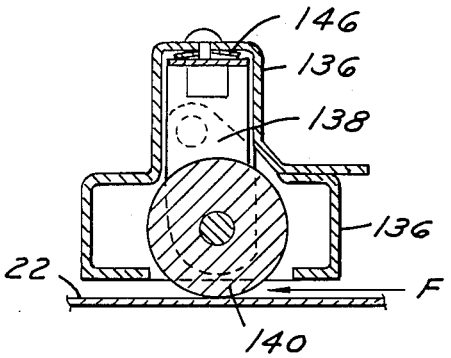
FIG. 8 is a cross-sectional view taken along line 8—8 of FIG. 7.

Cross-sectional views of carriage assembly 40 are shown in FIGS. 7 and 8. The carriage assembly is comprised of a carriage body 136, recirculating ballbearing retainers 42, roller framer 138 and roller 140. Roller 140 is free to rotate about an axis generally parallel to the document support surface 24 and perpendicular to the line of carriage 40's travel. In the preferred embodiment as shown in the drawings, roller 140 is pivotably attachd to roller frame 138 which in turn is attached to carriage housing 136, adjustable along an axis generally perpendicular to the plane of the frame. roller frame 138 is provided with threaded bosses 142 for receiving adjustment screws 144. By rotating adjustment screw 144, the roller framer 138 may be telescopically moved relative to carriage body 136, compressing wave spring 146 to adjust the roller to frame spacing. When the carriage as shown in FIG. 8 is translated to the right, the frictional force exerted on the roller represented by arrow F and the force exerted by the user causes carriage body 136 to rotate clockwise causing the roller to be firmly pressed against the document support surface. When moving the carriage in the opposite direction, i.e., to the left in FIG. 8, the force would be in the opposite direction, causing carriage body 136 to rotate clockwise, thereby minimizing the force of the roller against the document support surface. This novel feature not only allows the carriage to be moved easier in the return stroke, but automatically exerts the proper roller force on the document in spite of minor variations in the spacing between the carriage and document support surface caused by production tolerances.

It will be understood, of course, that while the form of the invention herein shown and described constitutes a preferred embodiment of the invention, it is not intended to illustrate all possible forms thereof. It will also be understood that the words used are words of description rather than of limitation, and that various changes may be made without departing from the spirit and scope of the invention disclosed.

I claim:

1. An apparatus for imprinting variable data on a document, the combination comprising:

a plurality of coaxially arranged type wheels each having an axial opening, a dog extending into said axial opening, and a succession of type faces on the wheel periphery;

support means for rotatably supporting the type wheels for contact with a document to be imprinted;

positioning means for rotatably positioning the type wheels, said positioning means extending through the axial openings of the type wheels to independently engage the dog of a selected type wheel;

index means for indexing the positioning means along the axis of the type wheels to successively engage and rotatably position selected wheels; and reset means to simultaneously reset the type wheels to a starting position said reset means extending through the axial opening of the type wheels for cooperating with the type wheel dogs.

2. The invention of claim 1 wherein said index means automatically shifts the positioning means successively from one type wheel to the next in response to the rotatable positioning of each wheel.

3. The invention of claim 2 wherein the positioning means further comprises coupling means for coupling the positioning means to a user, to rotate the engaged type wheel to the desired position.

4. The invention of claim 3 wherein the positioning means comprises a rotatable set slide having a tang thereon for engagement with the dog of a type wheel.

5. The invention of claim 4 wherein said reset means comprises a rotatable reset rotor which extends into the axial openings in the type wheels for engagement with the type wheel dogs.

6. The invention of claim 1 wherein said positioning means further comprises a set shaft and a set slide having a tang thereon to cooperate with a type wheel dog for rotation thereof, said set slide radially fixed to and slidable axially along the set shaft.

7. The invention of claim 6 wherein said positioning means further comprises return means to return the shaft to the initial position after each setting operation.

8. The invention of claim 7 wherein the indexing axially advances the set slide along the set shaft to engage the next type wheel prior to the next setting operation.

9. the invention of claim 8 wherein the said set shaft and set slide are coaxial with the type wheels and the set slide is capable of extending into the central opening of each type wheel to set the position thereof.

10. The invention of claim 9 wherein the reset means comprises a reset rotor which extends through the central opening in the type wheels for cooperating with each of the dogs on the type wheels to reset the type wheels to their initial position.

11. The invention of claim 3 wherein said support means further comprises a tubular hub having:

an internal cavity formed therein;

an axial lateral slot; and a plurality of circumaxial slots extending about a portion of the periphery to define a plurality of flexible fingers, each having a tip adjacent said lateral slot;

wherein said axial openings of said type wheels rotatably cooperate with said hub with said type wheel dogs projecting through said circumaxial slots and into said hub internal cavity.

12. The invention of claim 11 wherein the axial openings in said type wheels are further provided with a plurality of spaced apart notches for cooperating with said flexible fingertips formed in the hub to provide detent means for maintaining the type faces properly aligned.

13. The invention of claim 3 wherein said coupling means further comprises:

a rotatable set shaft for slidingly supporting said set slide while preventing the relative rotation thereof;

a wheel affixed to said shaft having a peripheral edge;

a rotatable idler having a peripheral edge aligned with said wheel and having an axis parallel to but spaced apart from said rotatable shaft;

a flexible finger ladder wrapping about a portion of said idler and said wheel peripheral edges to define a linear run therebetween, said finger ladder being provided with a plurality of recesses for cooperating with the user's finger, whereby, as the user moves the finger linearly, said wheel rotates, causing the shaft, set slide, and the type wheel in engagement therewith to be rotated to a location corresponding to the recess in the finger ladder in which the user's finger was inserted.

14. The invention of claim 1 further comprising:

a frame having a document support surface with a type wheel opening therein; and means to press the document against the type wheels to imprint the exposed type faces thereon.

15. The invention of claim 14 wherein said means to press the document against the type wheels to imprint the exposed type faces thereon further comprises:

a pair of guides parallel to said document support surface;

a carriage assembly extending between said guides having a pair of retainers having recirculating bearing balls for cooperation with said guides slidably retaining the carriage thereto so as to be movable along a linear path parallel to said guides; and a roller pivotably cooperating with said carriage assembly rotatable along an axis parallel to said document support surface and perpendicular to the linear path of said carriage assembly, said roller cooperating with the document to press the same against the document support surface and the type wheels exposed therethrough.

16. The invention of claim 15 wherein said carriage assembly further comprises a carriage housing centrally pivotably attached to said carriage assembly and rotatably along an axis parallel to and spaced apart from that of said roller, one end of said carriage housing pivotably supporting said roller and the opposite end for cooperation with a user wherein the pushing of the carriage in one linear direction causes the carriage housing to rotate and the roller to press against the document as the carriage assembly moves along said linear path, and movement of the carriage assembly in the opposite direction causes the carriage housing to rotate relative to the carriage assembly lifting the roller away from said document support surface as the carriage assembly translates along said linear path.

17. An apparatus for imprinting variable data on a document, comprising in combination:

a frame having a document support surface with a type wheel opening therein;

a plurality of coaxially arranged type wheels each having a succession of type faces on a segment of the periphery, a central axial opening, and a dog projecting into said axial opening;

a tubular journal having an outer diameter and an internal bore for rotatably supporting said type wheels below the frame support surface to expose the type faces through said opening, said journal having a plurality of axially spaced apart slots extending about a portion of said tubular journal through which the type wheel dogs extend so as to project into said internal bore;

a rotatable set slide which extends into and traverses along the journal bore having a tang thereon for independently engaging a type wheel dog to rotate a type wheel to the desired position;

individually setting the type wheels to the desired position;

means to automatically advance the said slide to the next adjacent type wheel after a wheel has been set to the desired position;

means to press the document against the type wheels to imprint the exposed type faces thereon;

a rotatable reset rotor extending through the tubular bore for cooperation with the type wheel dogs to reset the type wheels to a starting position; and means to manually position the set slide adjacent any desired type wheel.

18. The invention of claim 17 wherein said means to press the document against the type wheels further comprises:

a carriage slidably engaging the frame for translation along the document support surface; and a roller pivotably attached to the carriage and rollingly engaging the document support surface.

19. The invention of claim 18 wherein the carriage may be translated from an initial position along the length of the document support surface and be returned to the initial position to imprint type on a document supported thereon.

20. The invention of claim 19 further comprising a reset actuator which cooperates with the carriage during translation and rotates the reset rotor to return the type wheels to a starting position after the document has been imprinted.

21. The invention of claim 20 wherein the reset rotor threadingly cooperates with the reset actuator along an axis parallel to the carriage translation and coaxial to the reset rotor, whereby the translation of the reset actuator causes the reset rotor to rotate.

22. The invention of claim 4 wherein the positioning means further comprises a set shaft to which the set slide is rotatably affixed and axially shiftable, said set slide cooperates with and is axially positioned by the index means.

23. The invention of claim 1 further comprising a date wheel assembly wherein each date wheel is provided with raised indicia about a portion of its periphery and may be independently set by the user, comprising:

a frame cooperating with the support means of the type wheels;

a plurality of coaxially arranged cylindrical date wheels pivotably attached to said frame, each having a recessed shoulder formed in the peripheral edge, said recessed shoulder being further provided with a series of spaced apart notches corresponding to the spacing of said raised indicia;

a plurality of detent elements attached to said frame for cooperating with said notches in the date wheels to retain the indicia on the date wheels in aligned position; and a setter assembly pivotably attached to said frame for limited rotation about the date wheel axis, said date setter being provided with a plurality of flexible date setter fingers each having a free tip which can be deflected by the user from a non-cooperating position to a position engaging a notch in a date wheel recess shoulder, said setter assembly and engaged date wheel can thereby be rotated a predetermined amount corresponding to the angular spacing of said indicia.

24. The invention of claim 17 further comprising a date wheel assembly wherein each date wheel is provided with raised indicia about a portion of its periphery and may be independently set by the user, comprising:

a plurality of coaxially arranged cylindrical type wheels pivotally attached to said frame, each having a recessed shoulder former in the peripheral edge, said recessed shoulder being further provided witha series of spaced apart notches corresponding to the spacing of said raised indicia;

a plurality of detent elements attached to said frame for cooperating with said notches in the type wheels to retain the indicia on the type wheels in aligned position; and a setter assembly pivotably attached to said frame for limited rotation about the type wheel axis, said date setter being provided with a plurality of flexible date setter fingers each having a free tip which can be deflected by the user from a non-cooperating position to a position engaging a notch in a type wheel recess shoulder, said setter assembly and engaged type wheel can thereby be rotated a predetermined amount corresponding to the angular spacing of said indicia.

25. An apparatus for imprinting variable data on a document, comprising in combination:

a frame having a document support surface with a type wheel opening therein;

a plurality of coaxially arranged type wheels each having a succession of type faces on a segment of the periphery, a central axial opening, and a dog projecting into said axial opening;

a tubular journal having an outer diameter and an internal bore for rotatably supporting said type wheels below the frame support surface to expose the type faces through said opening, said journal having a plurality of axially spaced apart slots extending about a portion of said tubular journal through which the type wheel dogs extend so as to project into said internal bore;

a rotatable set slide which extends into and traverses along the journal bore having a tang thereon for independently engaging a type wheel dog to rotate a type wheel to the desired position;

means to couple the said slide to a user for individually setting the type wheels to the desired position;

means to automatically advance the said slide to the next adjacent type wheel after a wheel has been set to the desired position;

a carriage slidably engaging the frame for translation along the document support surface;

a roller pivotably attached to the carriage and rollingly engaging the document support surface, wherein the carriage and roller may be translated from an initial position along the length of the document support surface and be returned to the initial position to imprint type on a document supported thereon;

a rotatable reset rotor extending through the tubular bore for engagement with the type wheel dogs to return the type wheels to a starting position;

means to manually position the set slide adjacent any desired type wheel; and a reset actuator which cooperates with the carriage during translation and rotates the reset rotor to return the type wheels to a starting position after the document has been imprinted, wherein the reset rotor threadingly cooperates with the reset actuator along an axis parallel to the carriage translation and coaxial to the reset rotor, whereby the translation of the reset actuator causes the reset rotor to rotate.

* * * * *

UNITED STATES PATENT AND TRADEMARK OFFICE

CERTIFICATE OF CORRECTION

PATENT NO. : 4,628,812

DATED : December 16, 1986

INVENTOR(S) : JAMES C. FISK

It is certified that error appears in the above-identified patent and that said Letters Patent is hereby corrected as shown below:

In column 8, line 63, insert --- means --- after the word "indexing".

In column 10, line 33, insert --- means to couple the said slide to a user for --- before the word "individually".

Signed and Sealed this

Twenty-first Day of April, 1987

*Attest:*

DONALD J. QUIGG

*Attesting Officer*

*Commissioner of Patents and Trademarks*